US007371195B2

(12) United States Patent
Stevens

(10) Patent No.: US 7,371,195 B2
(45) Date of Patent: May 13, 2008

(54) COLLAPSIBLE SPORTS GOAL

(76) Inventor: Larry Richard Stevens, 9 Cameron Lane, Brantford, Ontario (CA) N3R 7T1

( * ) Notice: Subject to any disclaimer, the term of this patent is extended or adjusted under 35 U.S.C. 154(b) by 0 days.

(21) Appl. No.: 10/994,328

(22) Filed: Nov. 23, 2004

(65) Prior Publication Data

US 2006/0108742 A1 May 25, 2006

(51) Int. Cl.
*A63B 63/00* (2006.01)

(52) U.S. Cl. ..... 473/478; 273/400; 273/127 R

(58) Field of Classification Search ..... 273/398–402, 273/476, 478, 127 R, 127 B; 473/476–478
See application file for complete search history.

(56) References Cited

U.S. PATENT DOCUMENTS

| | | | | |
|---|---|---|---|---|
| 2,449,708 | A * | 9/1948 | Lindsay | 473/478 |
| 2,525,304 | A * | 10/1950 | Lindsay | 473/478 |
| 3,501,150 | A | 3/1970 | Frischman | |
| 3,642,282 | A * | 2/1972 | Frischman | 473/478 |
| 3,698,715 | A | 10/1972 | Browning et al. | |
| 4,664,384 | A | 5/1987 | Solla | |
| 5,186,469 | A * | 2/1993 | Terris | 473/478 |
| 5,273,292 | A * | 12/1993 | Pardi et al. | 273/400 |
| 5,427,381 | A | 6/1995 | Macaluso et al. | |
| 5,431,411 | A * | 7/1995 | Padilla | 473/416 |
| 5,533,733 | A * | 7/1996 | Dirnbeck | 273/400 |
| 5,539,957 | A | 7/1996 | Schmidt | |
| 5,655,774 | A * | 8/1997 | Cox | 473/478 |
| 5,681,045 | A * | 10/1997 | Liao | 273/400 |
| 5,830,089 | A * | 11/1998 | Halter et al. | 473/478 |
| 5,839,733 | A * | 11/1998 | Meeks et al. | 273/400 |
| 5,902,195 | A * | 5/1999 | Pavonetti | 473/478 |
| 5,902,196 | A * | 5/1999 | Chorneyko | 473/478 |
| 6,220,776 | B1 * | 4/2001 | Reeves | 403/102 |
| 6,432,002 | B1 * | 8/2002 | Pavonetti | 473/478 |
| 6,672,980 | B1 * | 1/2004 | Walsh | 473/478 |
| 6,716,122 | B2 | 4/2004 | Vermeulen | |
| 6,808,463 | B1 | 10/2004 | Stockwell, III | |
| 2002/0193189 | A1 * | 12/2002 | Goldwitz | 473/478 |
| 2003/0092513 | A1 | 5/2003 | Chen | |
| 2003/0153412 | A1 * | 8/2003 | Duba et al. | 473/478 |
| 2003/0166424 | A1 * | 9/2003 | Wu | 473/476 |
| 2004/0036222 | A1 * | 2/2004 | Chou | 273/407 |
| 2004/0072633 | A1 | 4/2004 | Webb | |
| 2004/0072634 | A1 | 4/2004 | Webb | |
| 2004/0116215 | A1 * | 6/2004 | Fobean et al. | 473/478 |
| 2005/0067785 | A1 * | 3/2005 | Moore, III | 273/407 |

* cited by examiner

*Primary Examiner*—Mark S Graham
(74) *Attorney, Agent, or Firm*—Hoffmann & Baron, LLP

(57) ABSTRACT

A collapsible sports goal comprising goal posts, supporting members, and a folding means for selective pivoting of the supporting members between an erect configuration and a collapsed configuration without disassembly. Each goal post has a base portion. An upper supporting member includes a crossbar engaging the goal posts. A lower supporting member includes left and right support bars and a rear interposed member engaged therebetween. Forward portions of the support bars securely and pivotably engage the goal posts adjacent to the base portion. The folding means engages the upper and lower supporting members in secure pivotable relation. In the erect configuration, the support bars extend rearwardly and normal to the goal posts, and the folding means extends vertically. In the collapsed configuration, the support bars extend parallel to the goal posts in a vertical direction.

10 Claims, 17 Drawing Sheets

COLLAPSIBLE SPORTS GOAL

FIELD OF THE INVENTION

The present invention relates to the field of sports goals, and more particularly, to a collapsible sports goal such as, for example, a hockey goal.

BACKGROUND OF THE INVENTION

By way of background, it is well known that hockey is an extraordinarily popular winter sport in many of the northern climes of the world and otherwise. Adults and children of all ages commonly spend many of their free waking hours playing hockey during the winter months, whether in an attempt to better hone their skills or merely for love of the game. In fact, the game is so popular that many ponds, roadways and streets—in rural, suburban and urban centers alike—may frequently play winter host to impromptu hockey games among the residents. Given the popularity of hockey, many have attempted to design a readily collapsible hockey goal that both is portable and takes up a small storage envelope when not in use.

For example, U.S. Pat. No. 3,501,150 (Frischman) teaches a series of separable tubular sections assembled to form a hockey goal. These tubular sections may telescopically connect when assembled. As with the aforementioned patent to Frischman, U.S. Pat. No. 3,698,715 (Browning et al.) discloses a collapsible goal which requires some preliminary disassembly, such as the removal of diagonal braces or wing nuts, prior to collapsing same into a storage configuration. In another example from the prior art, U.S. Pat. No. 5,539,957 (Schmidt) discloses a collapsible goal having an articulated frame which, although it does not require any preliminary disassembly, collapses in three dimensions and is extremely complicated to shift between the collapsed and erect configurations. In a last example from the prior art, U.S. Pat. No. 6,808,463 (Stockwell, III) discloses a soccer goal assembly which is more easily collapsible, but which is not portable due to anchor members which are required to be embedded in an associated playing surface. Moreover, the mere side folding and bracing means of the goal assembly disclosed in the patent to Stockwell, III are not particularly rugged and would make it difficult, if not impossible, to maintain the goal in an erect configuration were it not for the embedding of its anchor members in the playing surface.

What is needed, therefore, is a readily collapsible and rugged hockey goal that is suitable to withstand the rigors of a spirited game of hockey and is yet easily portable, without requiring any preliminary disassembly before collapsing same into a storage configuration that takes up a small storage envelope and may be hung substantially flat against a wall when not in use. Preferably, the design concept behind such a hockey goal would also make it capable of use in other sports contexts, and would allow a child of young age to assemble or dissemble same without requiring any hand tools, parental supervision or assistance.

It is, therefore, one object of the present invention to provide a readily collapsible sports goal.

It is another object of the present invention to provide a collapsible sports goal which might be used as a hockey goal.

It is a further object of the present invention to provide a collapsible hockey goal that is capable of withstanding the rigors of a spirited game of hockey.

It is a further object of the present invention to provide a collapsible sports goal that is easily portable.

It is still another object of the present invention to provide a collapsible sports goal that does not require any preliminary disassembly before collapsing same into a storage configuration.

It is a still further object of the present invention to provide a readily collapsible sports goal that occupies a small storage envelope and may be hung substantially flat against a wall when not in use.

It is yet another object of the present invention to provide a collapsible sports goal that allows a child of young age to assemble or dissemble same without requiring any hand tools, parental supervision or assistance.

It is a still yet further object of the present invention to provide a collapsible sports goal that has an improved net attaching means.

SUMMARY OF THE INVENTION

In accordance with the present invention there is disclosed a collapsible sports goal comprising left and right upright goal posts, upper and lower supporting members, and a rear folding means for selective pivoting of the lower supporting member between an erect configuration and a collapsed configuration. Each of the left and right upright goal posts respectively has a post upper end portion and a lower base portion. The upper supporting member includes a substantially horizontal front crossbar having left and right crossbar end portions, with each of the crossbar end portions securely engaging a respective one of the post upper end portions. The lower supporting member includes left and right support bars and a rear interposed member. Each of the left and right support bars respectively has forward and rearward end portions. The interposed member is substantially juxtaposed, in secure relation, between the rearward end portions of the left and right support bars respectively. Each forward end portion securely and pivotably engages a respective one of the upright goal posts substantially adjacent to its lower base portion. The rear folding means engages the lower supporting member in secure relation, and engages the upper supporting member in secure pivotable relation. In the erect configuration, the left and right support bars extend rearwardly and substantially normal to each of the upright goal posts. In the collapsed configuration, the left and right support bars extend substantially parallel to the upright goal posts in a substantially vertical direction.

In accordance with the preferred embodiment of the present invention, the rear folding means comprises an elongate rear post member having opposed rear post end portions. A first one of the rear post end portions engages the upper supporting member in the aforesaid secure pivotable relation. A respective other one of the rear post end portions pivotably engages the lower supporting member in the aforesaid secure relation. In the erect configuration, the rear post member extends substantially vertically.

In accordance with one aspect of the present invention, the rear interposed member is a substantially horizontal elongate member having left and right interposed end portions and an interposed central portion. Each of the interposed end portions securely engages a respective one of the rearward end portions. The respective other one of the rear post end portions pivotably engages the interposed central portion in the aforesaid secure relation.

In accordance with a further aspect of the preferred embodiment of the present invention, the upper supporting member further comprises a rear upper bar member that has left and right upper bar end portions and a substantially horizontal upper bar central portion. Each of the upper bar end portions securely and pivotably engages or extends from substantially adjacent to a respective one of the post upper end portions. The first one of the rear post end portions engages the rear upper bar member in the aforesaid secure pivotable relation.

In accordance with a further aspect of an alternate embodiment of the present invention, the upper supporting member further comprises a rear upper bar member that has left and right upper bar end portions and a substantially horizontal upper bar central portion. Each of the upper bar end portions securely and pivotably engages or extends from substantially adjacent to a respective one of the crossbar end portions. The first rear post end portion engages the rear upper bar member in the aforesaid secure pivotable relation.

In accordance with a yet further aspect of the present invention, the upper bar central portion is substantially parallel to the front crossbar, and each upper bar end portion extends in a substantially normal direction relative to the front crossbar.

In accordance with still another aspect of the present invention, in the erect configuration, each upper bar end portion extends in a substantially horizontal direction. In the collapsed configuration, each upper bar end portion extends in a substantially vertical direction.

In accordance with another aspect of the present invention, the first one of the rear post end portions engages the upper bar central portion of the rear upper bar member in the aforesaid secure pivotable relation.

In accordance with a still further aspect of the present invention, the rear post member comprises elongate upper and lower folding bar members. The upper folding bar member has a first hinged end portion and an opposed upward end portion that is substantially coterminous with the first one of the rear post end portions. The lower folding bar member has a second hinged end portion and an opposed downward end portion that is substantially coterminous with the respective other one of the rear post end portions. The first and second hinged end portions engage one another in hingedly secured relation.

In accordance with another aspect of the present invention, in the erect configuration, the upper and lower folding bar members extend in substantially collinear relation with one another. In the collapsed configuration, the upper and lower folding bar members are removed from the aforesaid substantially collinear relation.

In accordance with yet another aspect of the present invention, the rear post member further comprises a locking means for selective movement of the upper and lower folding bar members between a locked configuration and an unlocked configuration. In the locked configuration, the upper and lower folding bar members are securely maintained in the aforesaid substantially collinear relation, with the upper and lower supporting members in the erect configuration. In the unlocked configuration, the upper and lower folding bar members are permitted to move from the substantially collinear relation, and the upper and lower supporting members are permitted to move between the erect configuration and the collapsed configuration.

In accordance with another aspect of the present invention, a first folding bar member of the upper and lower folding bar members is shaped so as to define a locking aperture extending therethrough in a first substantially transverse direction. The locking means comprises a locking pin member engaging a respective other folding bar member of the upper and lower folding bar members. In the locked configuration, the locking pin member securely engages the locking aperture in removable through-passing relation. In the unlocked configuration, the locking pin member is removed from the aforesaid secure engagement with the locking aperture.

In accordance with still yet another aspect of the present invention, the locking pin member comprises a selectively depressable locking pushbutton member that is biased towards the locked configuration. According to this aspect of the invention, when the upper and lower folding bar members are in the aforesaid substantially collinear relation, the locking pushbutton member extends into secure depressably removable through-passing relation with the locking aperture.

In accordance with a further aspect of the present invention, the first folding bar member is the upper folding bar member, and the respective other folding bar member is the lower folding bar member.

In accordance with a still yet further aspect of the present invention, the upper folding bar member is shaped and dimensioned to define a substantially longitudinal channel extending therealong from substantially adjacent to the first hinged end portion towards the upward end portion. The longitudinal channel is adapted to receive the second hinged end portion. The locking aperture extends as aforesaid through the first folding bar member substantially adjacent to the longitudinal channel. The upper folding bar is further shaped and dimensioned to define an unlocking aperture substantially adjacent to the longitudinal channel and extending therethrough in a second substantially transverse direction. The unlocking aperture is adapted to receive the second hinged end portion in the unlocked configuration.

In accordance with a different aspect of the present invention, each lower base portion of each of the upright goal posts comprises a rearwardly extending portion that is shaped and dimensioned so as to each respectively define a rearward extending upward-facing channel. Each upward-facing channel is adapted to receive a respective one forward end portion of the support bars. Each rearwardly extending portion is further shaped and dimensioned so as to define a respective lower collapsing aperture substantially adjacent to the respective upward-facing channel and extending therethrough in a substantially vertical direction. Each lower collapsing aperture is adapted to receive a respective one forward end portion of the support bars in the collapsed configuration.

In accordance with still another different aspect of the present invention, each post upper end portion of each of the upright goal posts comprises a rearwardly extending upper bar engaging portion that is shaped and dimensioned so as to each respectively define a rearward extending downward-facing channel. Each downward-facing channel is adapted to receive a respective one of the upper bar end portions. Each rearwardly extending upper bar engaging portion is further shaped and dimensioned so as to define a respective upper collapsing aperture substantially adjacent to the respective downward-facing channel and extending therethrough in a substantially vertical direction. Each upper collapsing aperture is adapted to receive a respective one of the upper bar end portions in the collapsed configuration.

In accordance with a separate aspect of the present invention, the collapsible sports goal further comprises a web of netting material and a net attaching means for readily attaching the web to the upright goal posts, the front crossbar, the support bars, and the rear interposed member.

In accordance with a further aspect of the present invention, the net attaching means comprises a plurality of spiral bent eyelets securely affixed to the upright goal posts, the front crossbar, the support bars, and the rear interposed member in substantially continuous relation to one another.

In accordance with another aspect of the present invention, the plurality of bent steel eyelets are affixed to a substantially rearward facing portion of each of the upright goal posts and the front crossbar, and to a substantially upward facing portion of each of the support bars and the rear interposed member.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings and photographs, the latter of which are briefly described hereinbelow.

BRIEF DESCRIPTION OF THE DRAWINGS

The novel features which are believed to be characteristic of the collapsible sports goal according to the present invention, as to its structure, organization, use and method of operation, together with further objectives and advantages thereof, will be better understood from the following drawings and photographs in which a presently preferred embodiment of the invention will now be illustrated by way of example. It is expressly understood, however, that the drawings and photographs are for the purpose of illustration and description only, and are not intended as a definition of the limits of the invention. In the accompanying drawings and photographs.

DETAILED DESCRIPTION OF A PREFERRED EMBODIMENT

Figure 1:
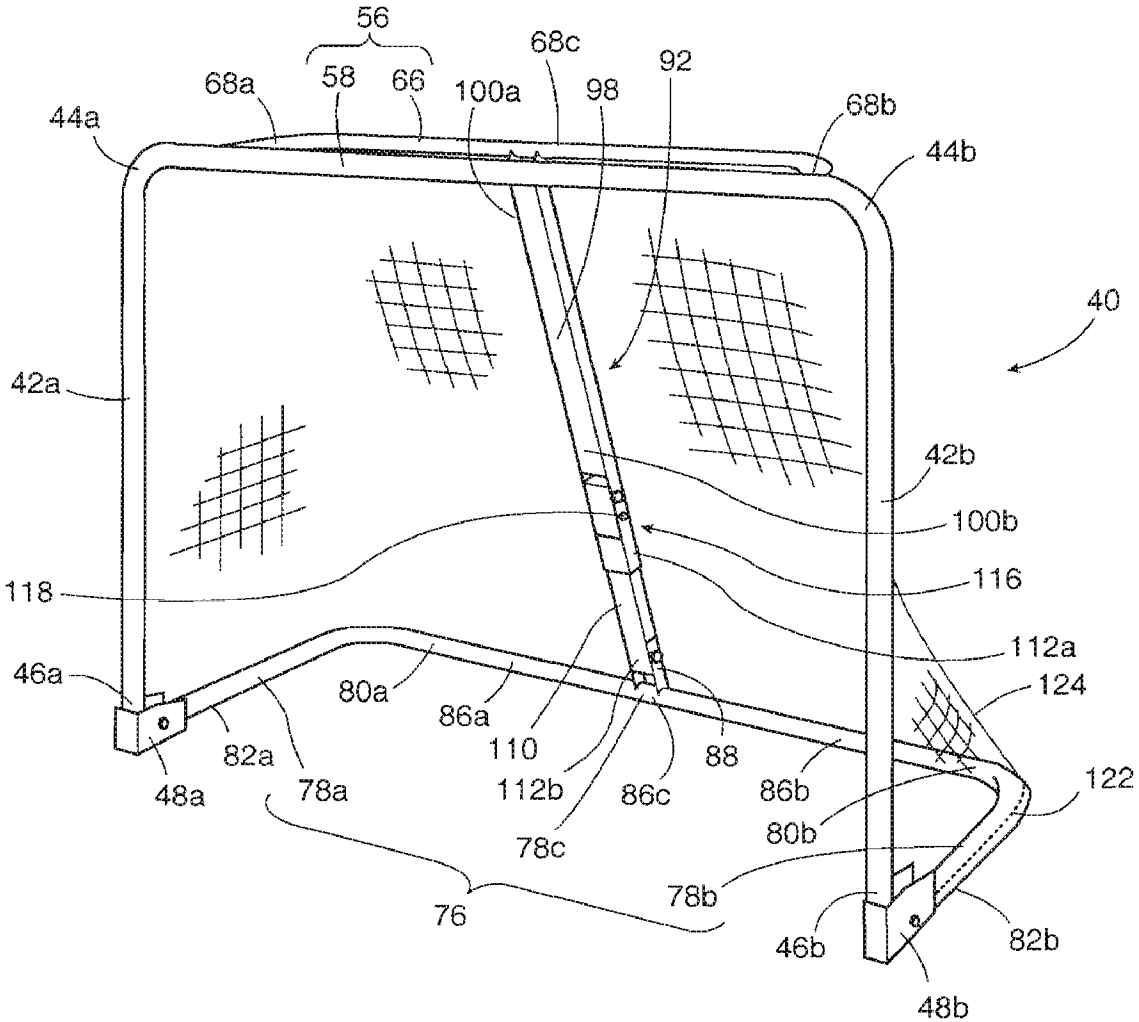
FIG. 1 is a top front right perspective view of a preferred embodiment of a collapsible sports goal according to the invention, shown in an erect configuration.
Figure 2:
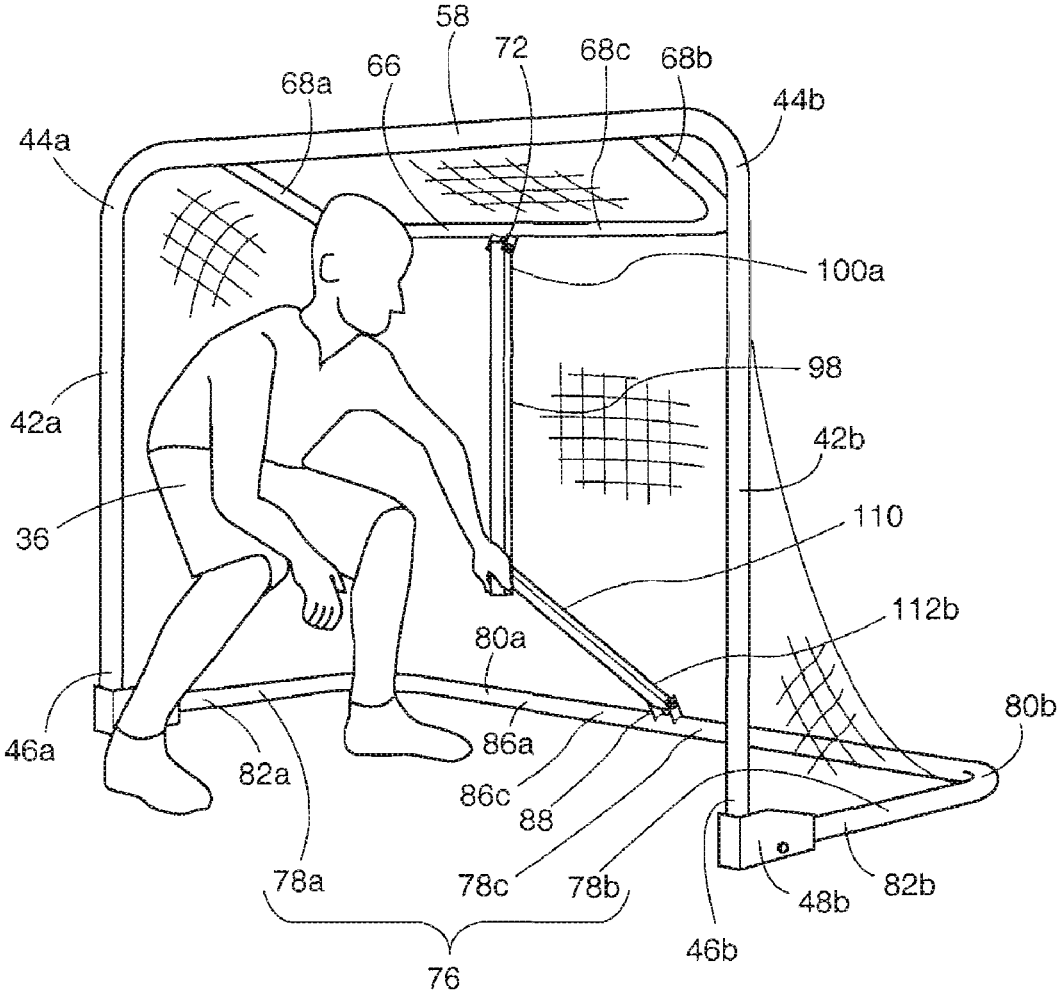
FIG. 2 is a top front right perspective view of the collapsible sports goal of FIG. 1 shown in a first unlocked configuration.

Referring now to FIGS. 1 through 35, there is shown a collapsible sports goal 40 such as might be used, for example, in playing ice or street hockey. The sports goal 40 includes left and right upright goal posts 42*a*, 42*b*, upper and lower supporting members 56, 76, and a rear folding means 92 for selective pivoting of the upper and lower supporting members 56, 76 between an erect configuration (best seen in FIGS. 1, 12 and 13) and a collapsed configuration (best seen in FIGS. 8, 9 and 14).

Each of the left and right upright goal posts 42*a*, 42*b* has a respective post upper end portion 44*a*, 44*b* and a respective lower base portion 46*a*, 46*b*.

The upper supporting member 56 includes a. substantially horizontal front crossbar 58 and a rear upper bar member 66. The front cross bar 58 has left and right crossbar end portions 60*a*, 60*b*. Each of the crossbar end portions 60*a*, 60*b* securely engages a respective one of the post upper end portions 44*a*, 44*b*. The rear upper bar member 66 has left and right upper bar end portions 68*a*, 68*b* and an upper bar central portion 68*c* that is substantially parallel to the front crossbar 58. Each upper bar end portion 68*a*, 68*b* extends in a substantially normal direction relative to the front crossbar 58.

Figure 3:
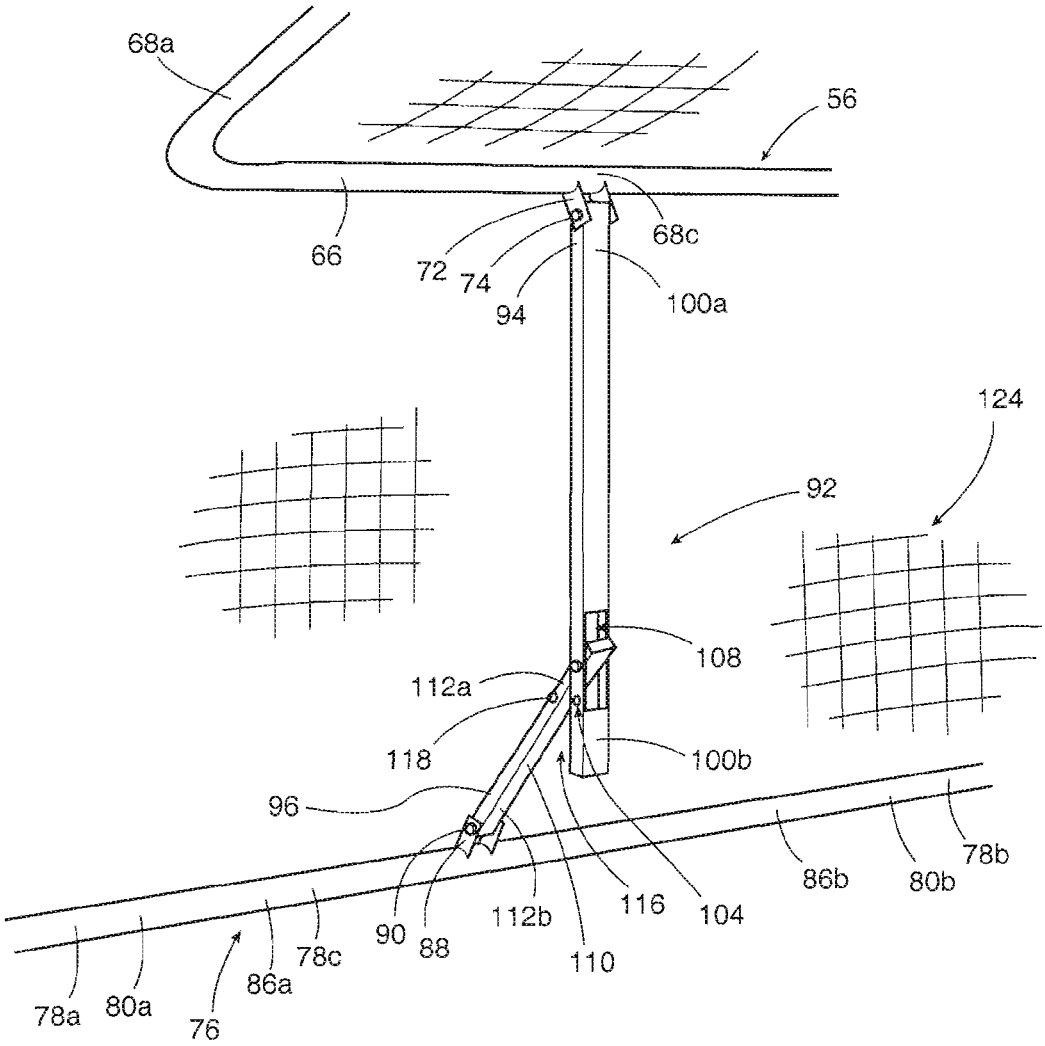
FIG. 3 is an enlarged top front left perspective view of the collapsible sports goal of FIG. 2.
Figure 4:
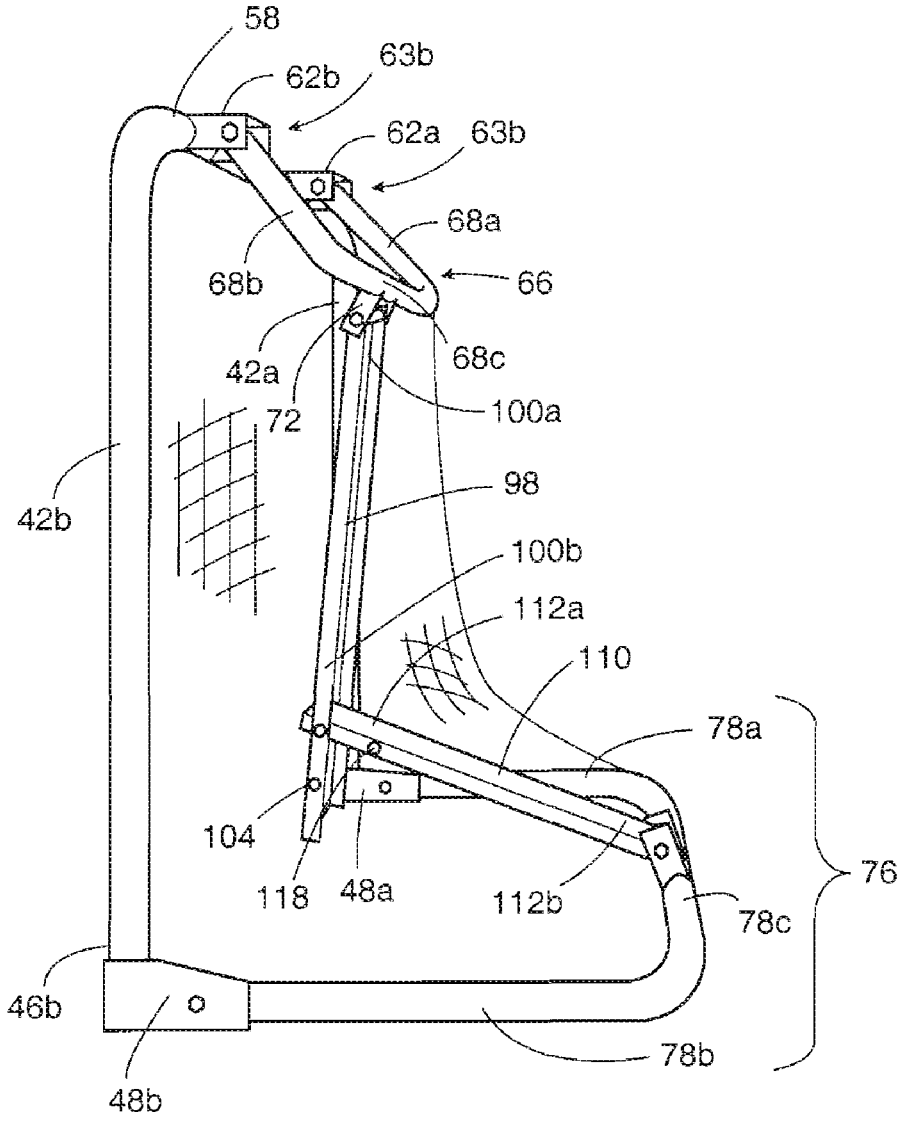
FIG. 4 is a right side rear top perspective view of the collapsible sports goal of FIG. 2.
Figure 7:
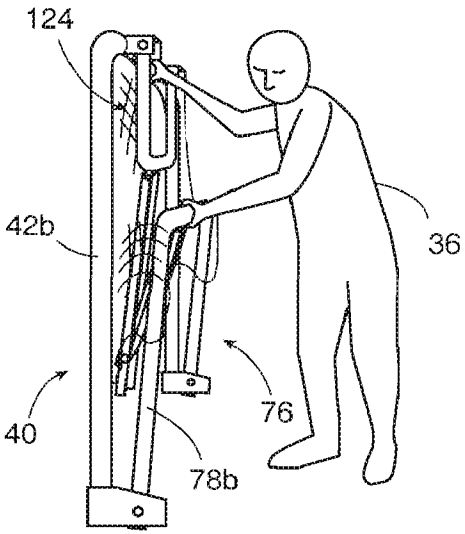
FIG. 7 is a view similar to FIG. 5 with the collapsible sports goal shown in a collapsed configuration.
Figure 6:
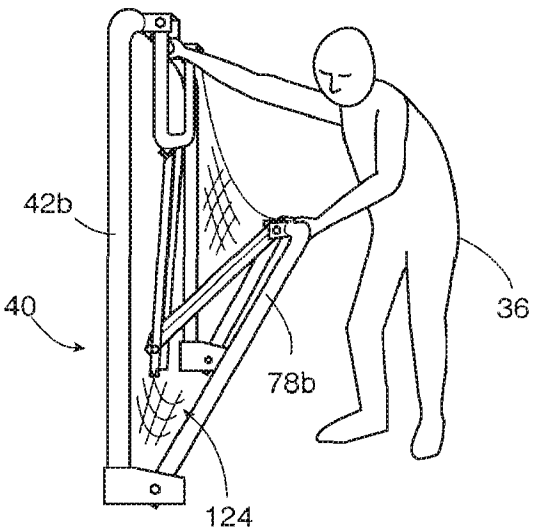
FIG. 6 is a view similar to FIG. 5 with the collapsible sports goal shown in a second unlocked configuration.
Figure 5:
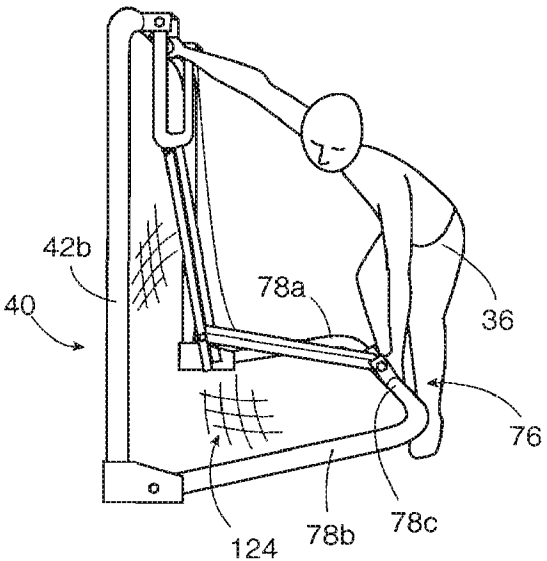
FIG. 5 is a right side rear top perspective view of the collapsible sports goal of FIG. 4.
Figure 8:
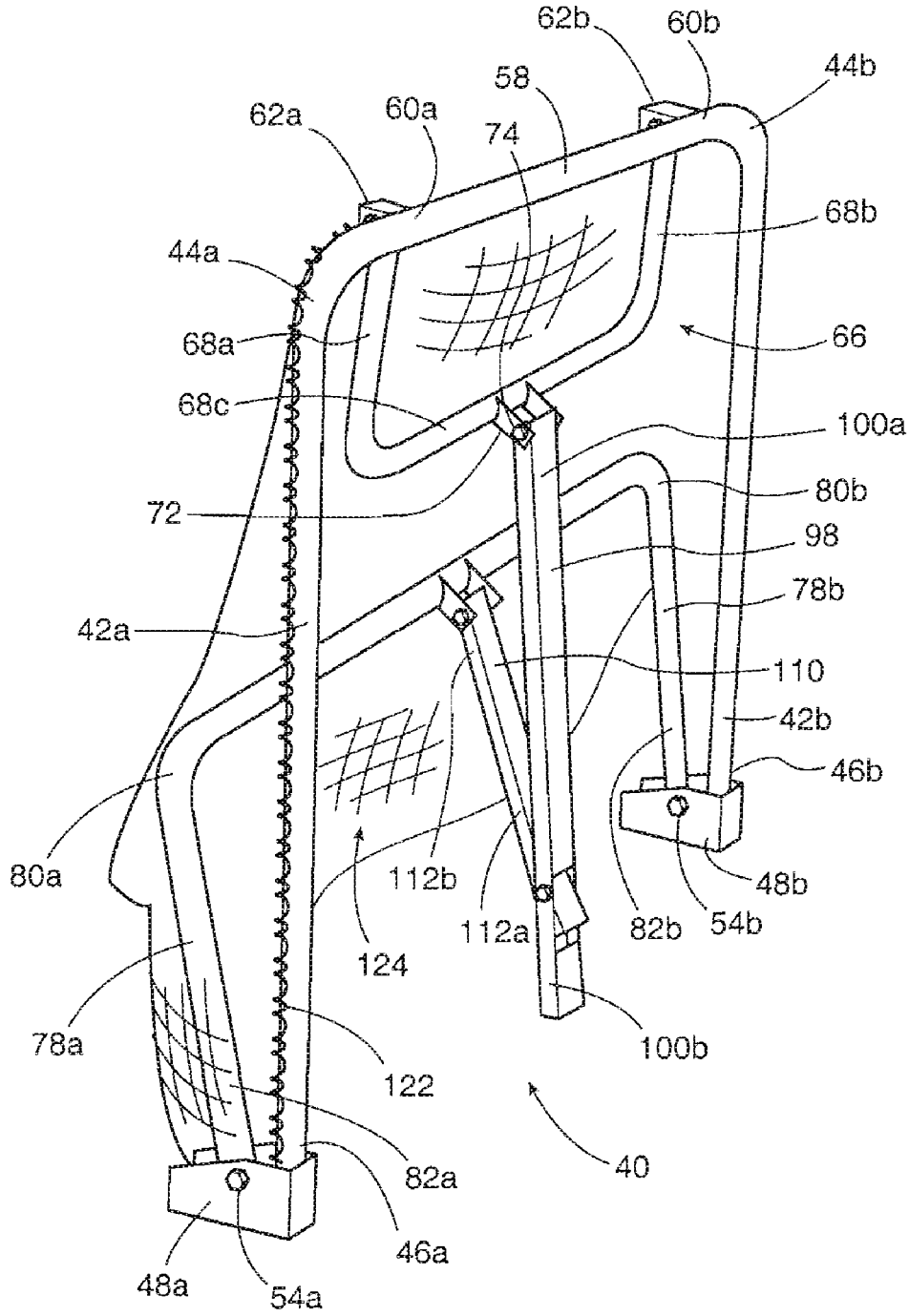
FIG. 8 is a left side front top perspective view of the collapsible sports goal of FIG. 7.
Figure 9:
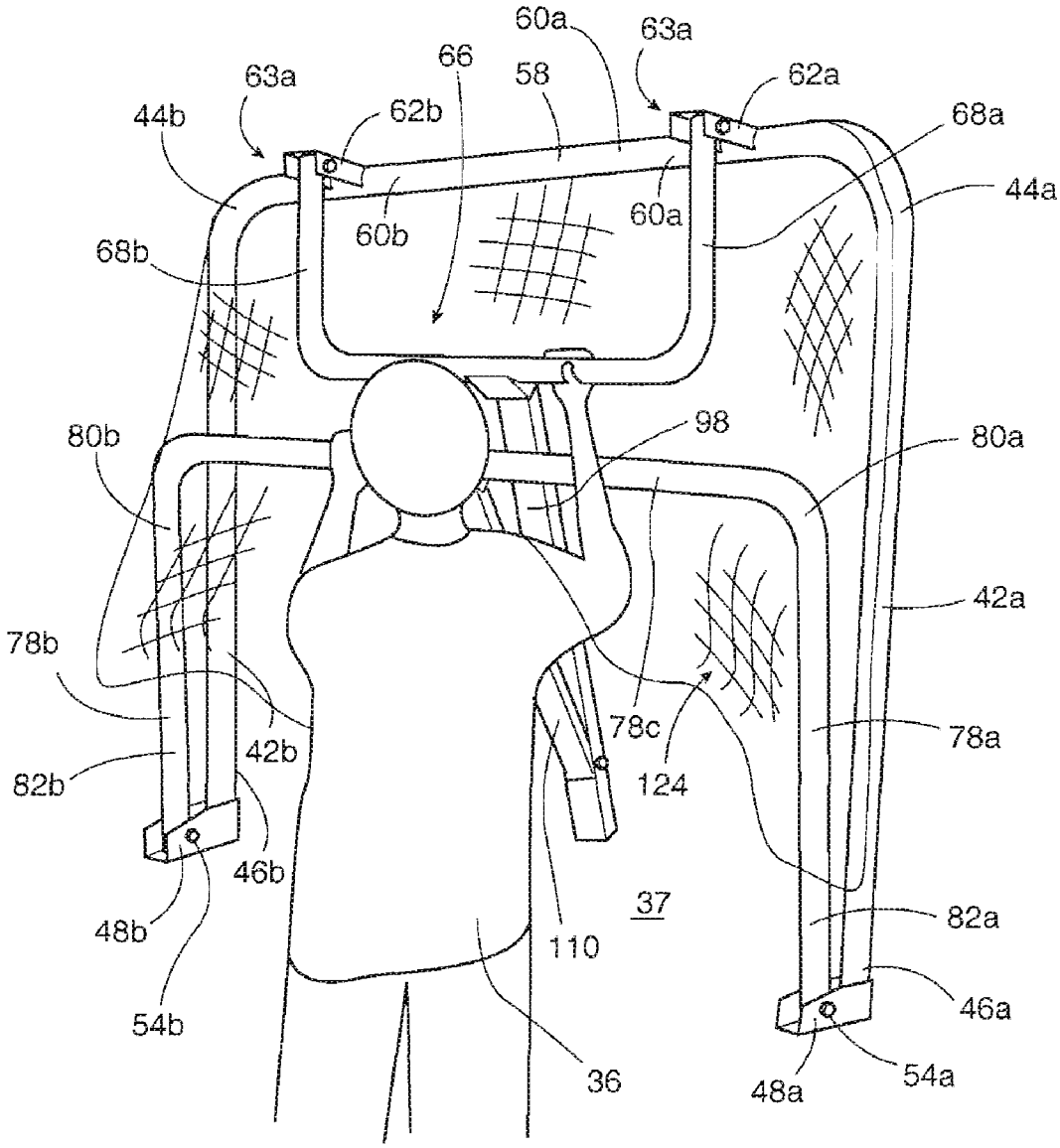
FIG. 9 is a rear left side perspective view of the collapsible sports goal of FIG. 7 being stored by a user substantially flat against a wall.
Figure 10:
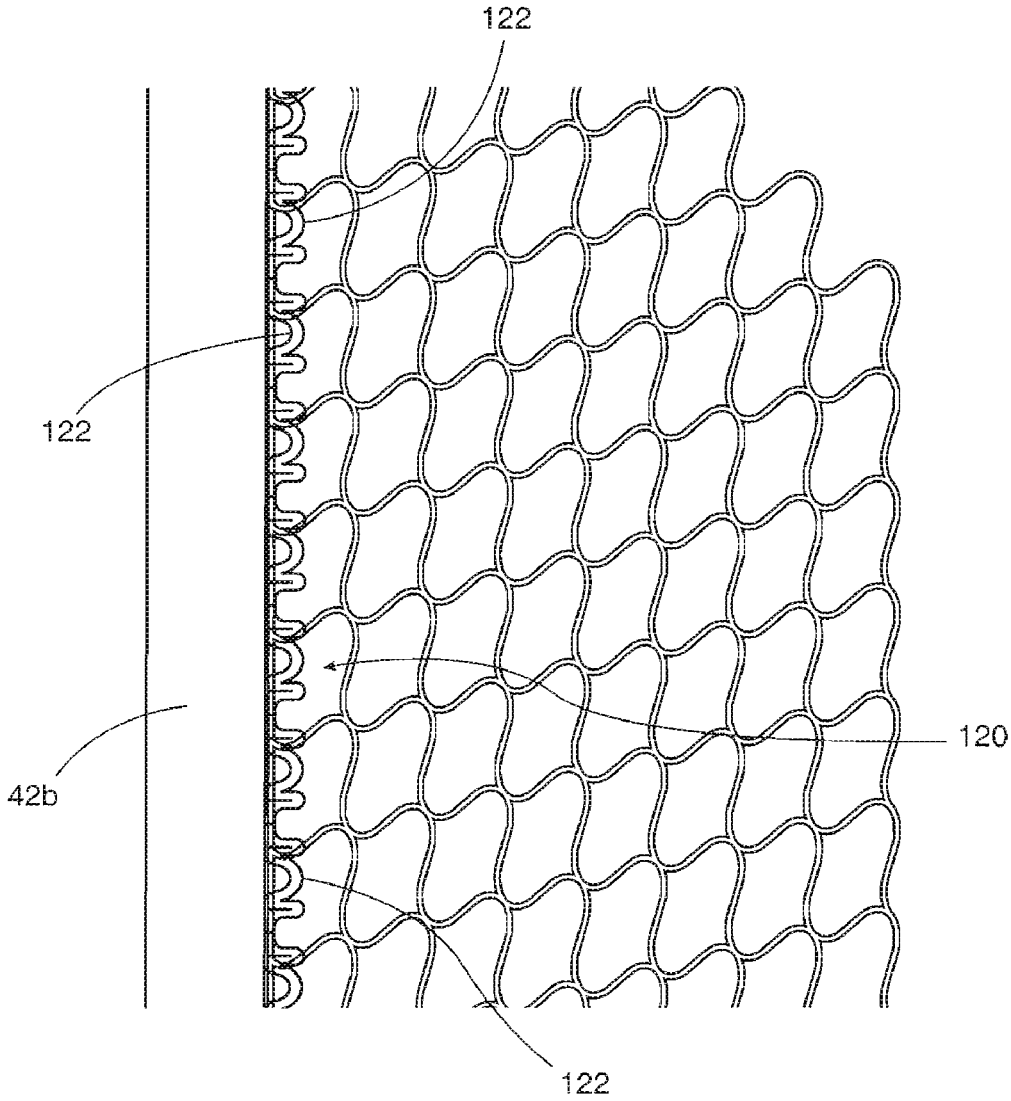
FIG. 10 is an enlarged rear right side perspective view of the collapsible sports goal of FIG. 1.

In a preferred embodiment of the sports goals 40 that is shown in FIGS. 1 through 10, and as best seen in FIGS. 8 and 9, each of the upper bar end portions 68*a*, 68*b* securely and pivotably engages and extends from substantially adjacent to a respective one of the post upper end portions 44*a*, 44*b*. More specifically, and as shown in FIGS. 4 and 9, each post upper end portion 44*a*, 44*b* of the upright goal posts 42*a*, 42*b* has a respective rearwardly extending upper bar engaging portion 62*a*, 62*b*.

Figure 11:
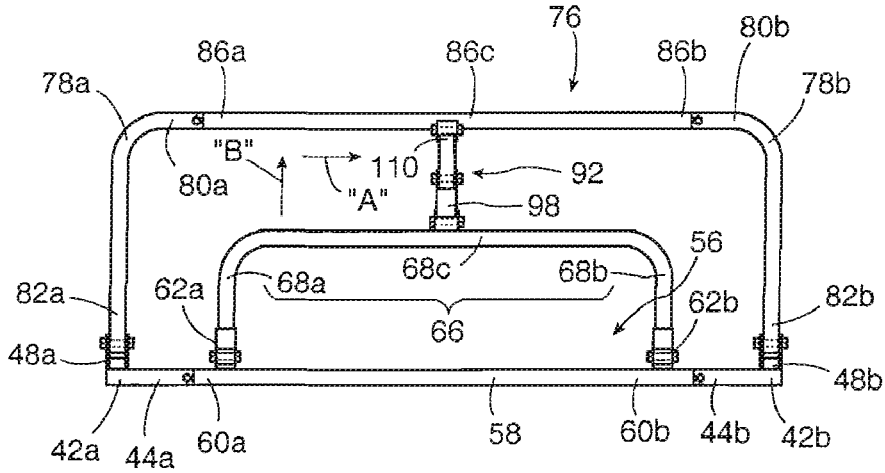
FIG. 11 is a top elevational view of an alternate embodiment of a collapsible sports goal according to the invention, shown without netting in the erect configuration.
Figure 12:
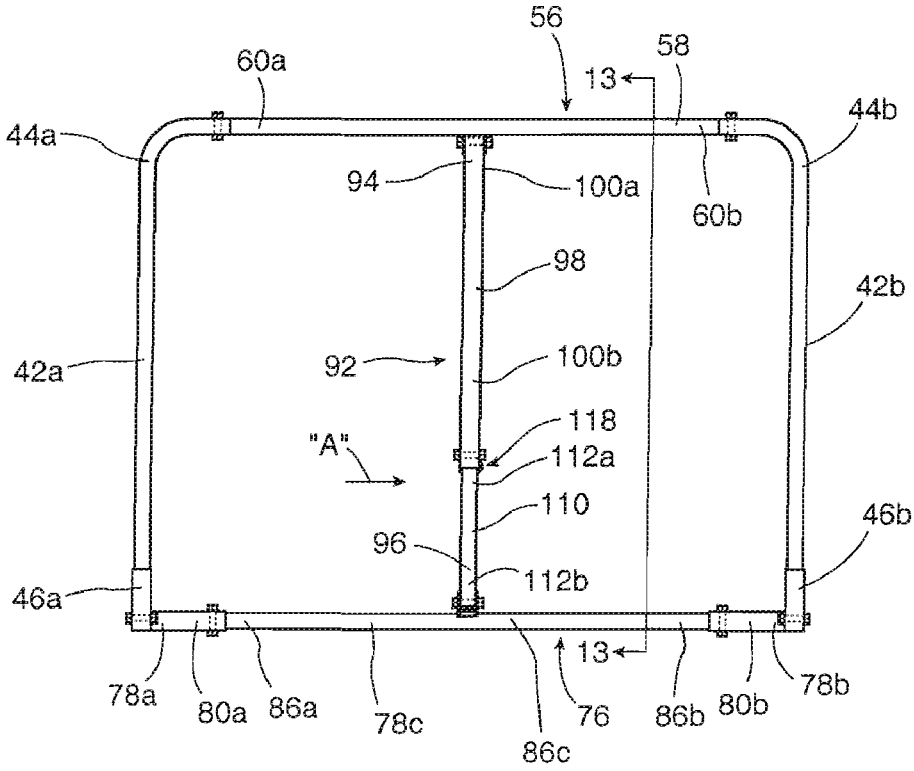
FIG. 12 is a front elevational view of the collapsible sports goal of FIG. 11.
Figure 17:
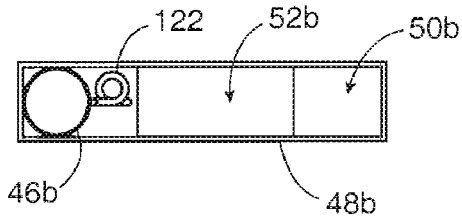
FIG. 17 is a view of the upright goal post of FIG. 16 along sight line 17-17.
Figure 18:
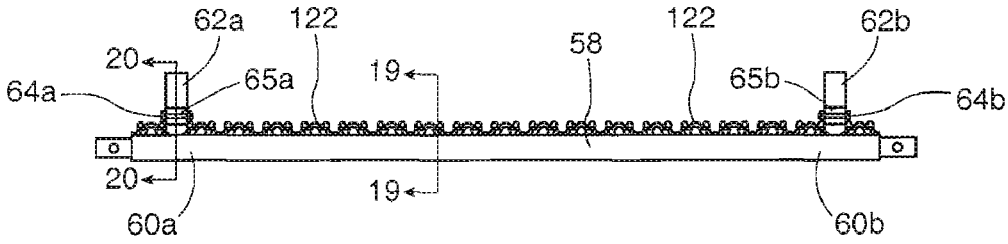
FIG. 18 is an exploded top elevational view of a front crossbar shown in FIG. 11.
Figure 19:
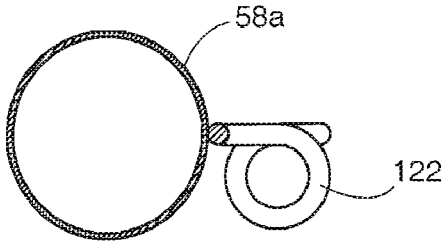
FIG. 19 is a view along sight line 19-19 of FIG. 18.

According to an alternate embodiment of the invention that is shown in FIGS. 11 through 34, and as best seen in FIGS. 11 and 18, each of the upper bar end portions 68*a*, 68*b* alternately securely and pivotably engages and extends from substantially adjacent to a respective one of the crossbar end portions 60*a*, 60*b*. According to this alternate embodiment, and as shown in FIGS. 11, 14, 18 and 20, the upper bar engaging portions 62*a*, 62*b* extend rearwardly from each crossbar end portion 60*a*, 60*b* (instead of from the post upper end portions 44*a*, 44*b*).

Figure 20:
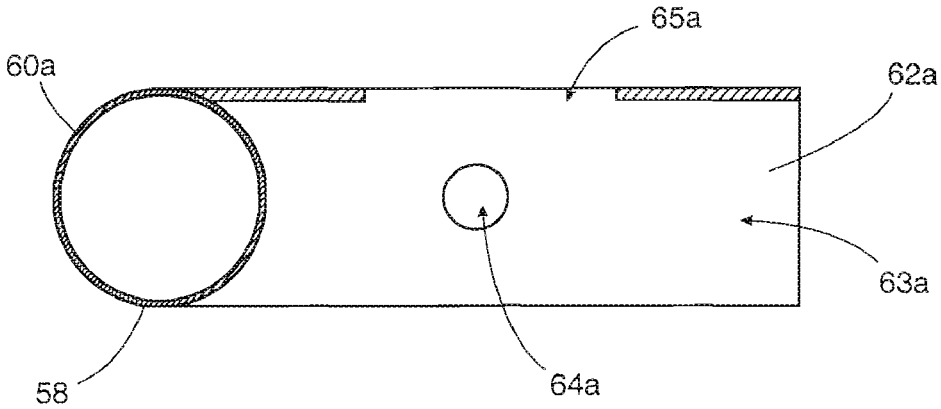
FIG. 20 is a view along sight line 20-20 of FIG. 18.
Figure 24:
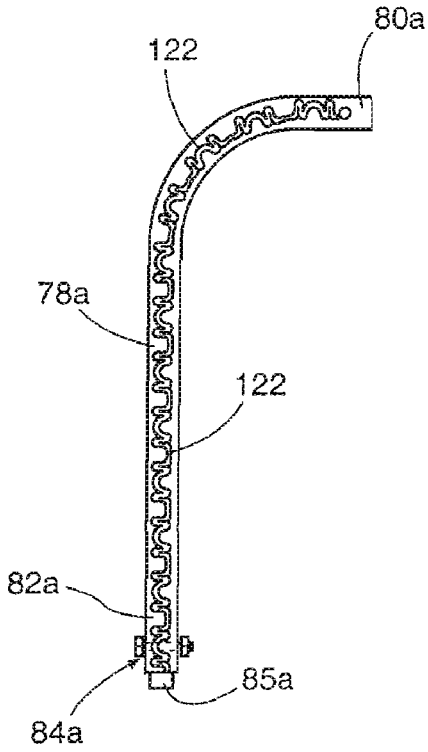
FIG. 24 is an exploded top elevational view of a left support bar shown in FIG. 11.
Figure 25:
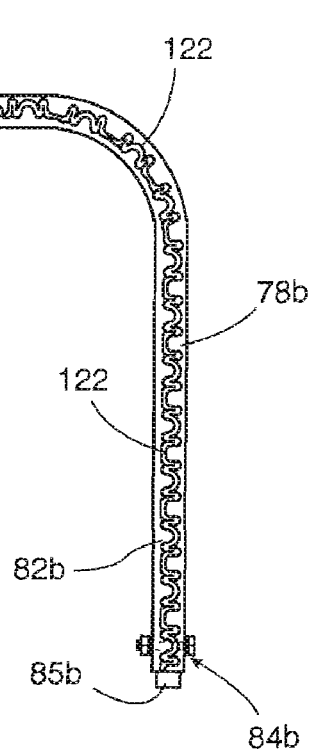
FIG. 25 is an exploded top elevational view of a right support bar shown in FIG. 11.
Figure 27:
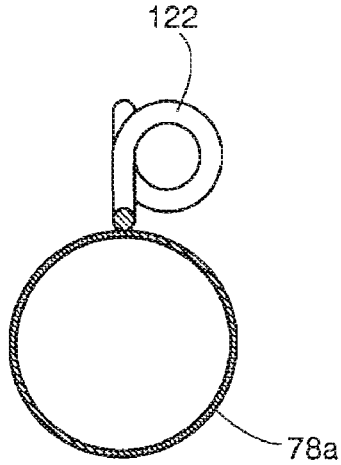
FIG. 27 is a view along sight line 27-27 of FIG. 26.
Figure 26:
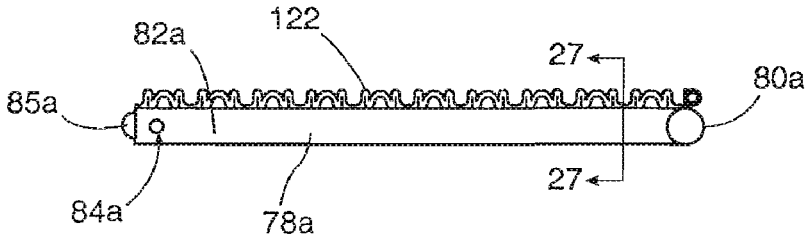
FIG. 26 is a right elevational view of the left support bar of FIG. 24.

In both the preferred and the alternate embodiments of the sports goal 40, and as best seen in FIGS. 4, 9 and 20, each of the upper bar engaging portions 62*a*, 62*b* is shaped and dimensioned to define a downward-facing channel 63*a*, 63*b*. Each downward-facing channel 63*a*, 63*b* is adapted to receive a respective one of the upper bar end portions 68*a*, 68*b* of the rear upper bar member 66. In order that the upper bar end portions 68*a*, 68*b* might securely and pivotably engage the upper bar engaging portions 62*a*, 62*b*, and as best seen in FIGS. 24 to 26, rear upper bar member 66 is shaped so as to define two crossbar fastening apertures 70*a*, 70*b*, one each substantially adjacent to each respective upper bar end portion 82*a*, 82*b*.

As best shown in FIGS. 18 and 20, each of the upper bar engaging portions 62*a*, 62*b* is further shaped and dimensioned to define a respective upper collapsing aperture 65*a*, 65*b*, extending therethrough in a substantially vertical direction, substantially adjacent to its respective downward-facing channel 63*a*, 63*b*. Each upper bar engaging portion 62*a*, 62*b* is further provided with respective upper bar fastening means 64*a*, 64*b* for securely and pivotably fastening a respective one of the cross bar end portions 60*a*, 60*b* thereto. In the preferred and alternate embodiments of the sports goal 40 which are depicted in the figures, and as best seen in FIGS. 11, 13, and 21-22, the upper bar fastening means 64*a*, 64*b* may take the form of a nut and bolt assembly that extends through a respective one of the crossbar fastening apertures 70*a*, 70*b* and is secured to the respective upper bar portion 62*a*, 62*b*.

The lower supporting member 76 includes left and right support bars 78*a*, 78*b* and a rear interposed member 78*c*. Each of the left and right support bars 78*a*, 78*b* has a respective forward end portion 82*a*, 82*b* and a respective rearward end portion 80*a*, 80*b*. The rear interposed member 78*c* is substantially juxtaposed in secure relation between the respective rearward end portions 80*a*, 80*b* of the left and right support bars 78*a*, 78*b*. Each forward end portion 82*a*, 82*b* securely and pivotably engages a respective one of the upright goal posts 42*a*, 42*b* substantially adjacent to its lower base portion 46*a*, 46*b*. For this purpose, in both the preferred and alternate embodiments of the sports goal 40 which are shown in the figures, and as best seen in FIGS. 24 to 26, each of the left and right support bars 78*a*, 78*b* is shaped so as to define a respective base fastening aperture 84*a*, 84*b* substantially adjacent to its forward end portion 82*a*, 82*b*.

As will be best appreciated from FIG. 17, wherein a representative lower base portion 46*b* is shown, each lower base portion 46*a*, 46*b* of the upright goal posts 42*a*, 42*b* has a respective rearwardly extending portion 48*a*, 48*b*. Each of the rearwardly extending portions 48*a*, 48*b* is shaped and dimensioned to define a respective rearward extending upward-facing channel 50*a*, 50*b*. Each upward-facing channel 50*a*, 50*b* is adapted to receive a respective one of the forward end portions 82*a*, 82*b* of the left and right support bars 78*a*, 78*b*. Each rearwardly extending portion 48*a*, 48*b* is further shaped and dimensioned to define a respective lower collapsing aperture 52*a*, 52*b* substantially adjacent to its respective upward-facing channel 50*a*, 50*b* which extends therethrough in a substantially vertical direction.

Each rearwardly extending portion 48*a*, 48*b* is further provided with respective support bar fastening means 54*a*, 54*b* for securely and pivotably fastening a respective one of the left and right support bars 78*a*, 78*b* thereto. In the preferred and alternate embodiments of the sports goal 40 which are depicted in the figures, and as best seen in FIGS. 11, 13, and 24-26, the support bar fastening means 54*a*, 54*b* may take the form of a nut and bolt assembly that extends through a respective one of the base fastening apertures 84*a*, 84*b* and is secured to the respective rearwardly extending portion 48*a*, 48*b*.

The rear interposed member 78*c* is substantially elongate and has left and right interposed end portions 86*a*, 86*b* and an interposed central portion 86*c*. Each of the interposed end portions 86*a*, 86*b* securely engages a respective one of the rearward end portions 80*a*, 80*b*.

Figure 31:
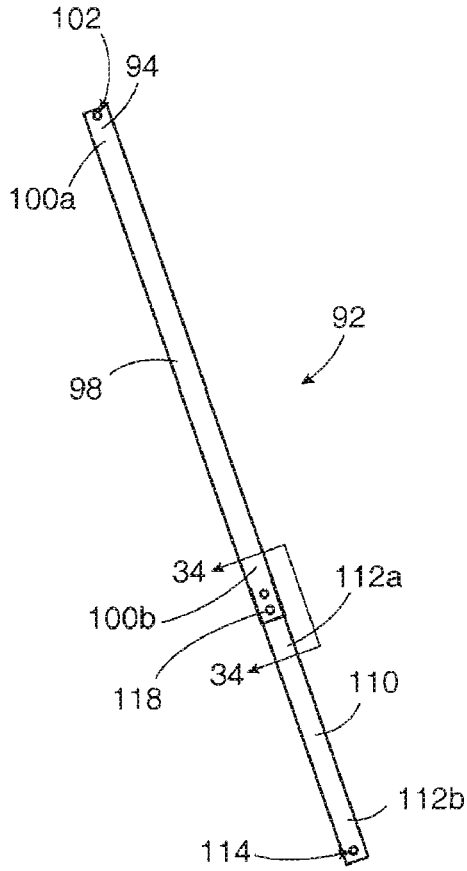
FIG. 31 is an exploded right elevational view of a rear post member shown in FIG. 11.

Preferably, the rear folding means 92 takes the form of an elongate rear post member having opposed rear post end portions 94, 96. Each of the opposed rear post end portions 94, 96 engages a respective one of the upper and lower supporting members 56, 76 in secure pivotable relation for movement, as aforesaid, between the erect configuration (best seen in FIG. 1) and the collapsed configuration (best seen in FIGS. 8 and 9). More specifically, a first rear post end portion 94 pivotably engages the upper bar central portion 68*c* of the rear upper bar member 66, and a respective other rear post end portion 96 pivotably engages the interposed central portion 86*c* of the rear interposed member 78*c*. For this purpose, and as best seen in FIG. 31, the rear post member 92 is shaped so as to define an upper bar fastening aperture 102 substantially adjacent to the first rear post end portion 94, and a rear interposed fastening aperture 114 substantially adjacent to the respective other rear post end portion 96.

Figure 21:
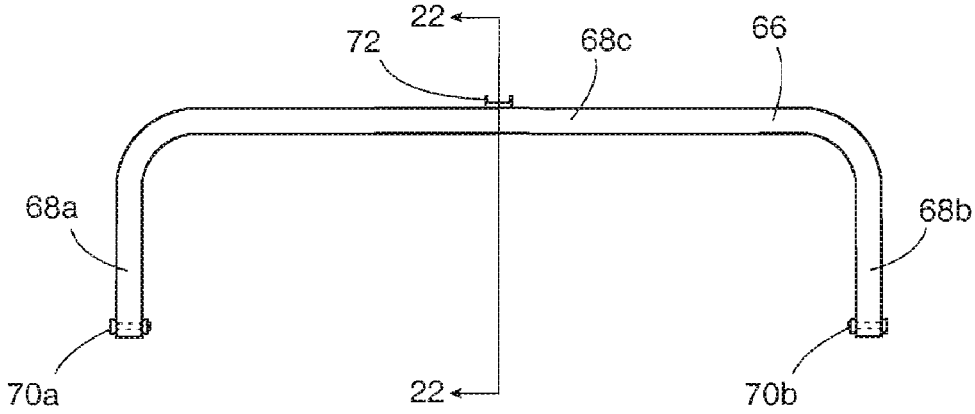
FIG. 21 is an exploded top elevational view of a rear upper bar member shown in FIG. 11.
Figure 22:
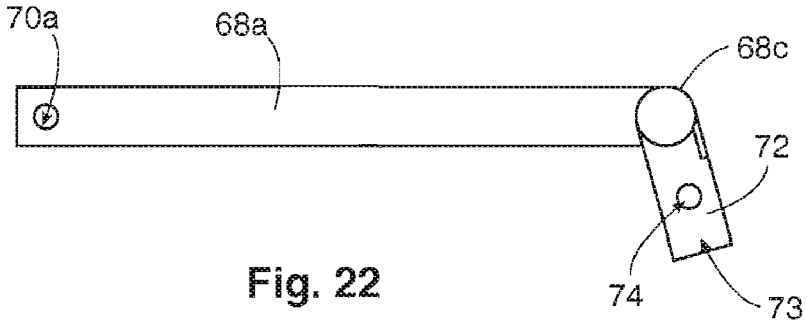
FIG. 22 is a view along sight line 22-22 of FIG. 21.
Figure 23:
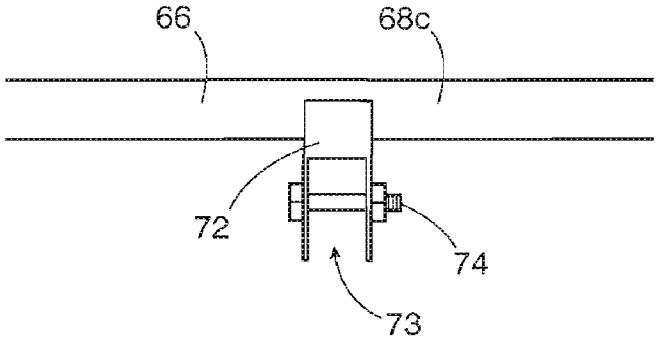
FIG. 23 is an enlarged bottom elevational view of the rear upper bar member of FIG. 21.

As best seen in FIGS. 21 through 23, the rear upper bar member 66 is provided with a downwardly extending rear post engaging member 72 which is shaped and dimensioned to define a downward-facing channel 73. The downward-facing channel 73 is adapted to receive the first rear post end portion 94. The downwardly extending rear post engaging member 72 is further provided with an upper rear post fastening means 74 for securely and pivotably fastening the rear post member 92 thereto. As best seen in FIGS. 21-23 and 31, the upper rear post fastening means 74 may take the form of a nut and bolt assembly that extends through the upper bar fastening aperture 102 and is secured to the downwardly extending rear post engaging member 72.

Figure 28:
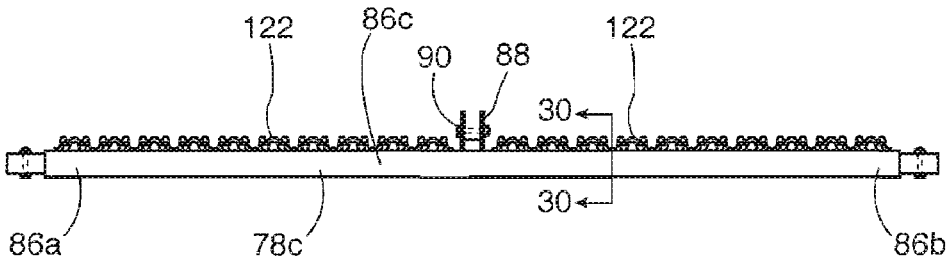
FIG. 28 is an exploded front elevational view of a rear interposed member shown in FIG. 11.
Figure 29:
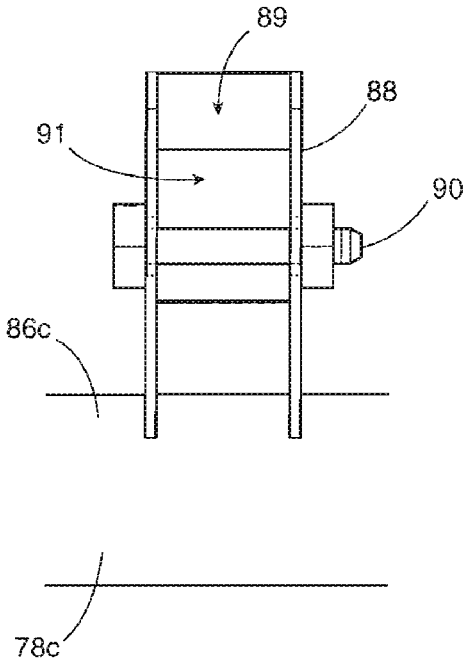
FIG. 29 is an enlarged front elevational view of the rear interposed member of FIG. 28.
Figure 30:
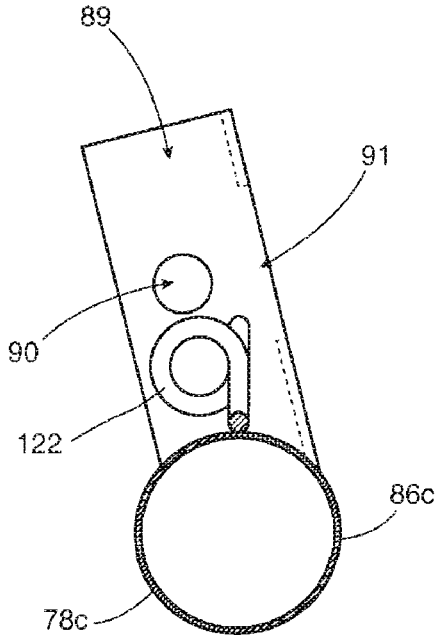
FIG. 30 is a view along sight line 30-30 of FIG. 28.
Figure 32:
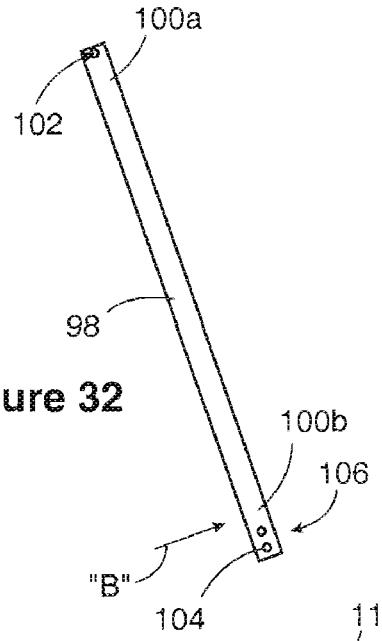
FIG. 32 is an exploded right elevational view of an upper folding bar member shown in FIG. 31.
Figure 33:
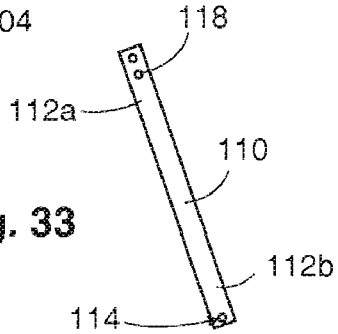
FIG. 33 is an exploded right elevational view of a lower folding bar member shown in FIG. 31.

As best seen in FIGS. 28 through 30, the rear interposed member 78*c* is provided with an upwardly extending rear post engaging member 88 which is shaped and dimensioned to define a forward-facing channel 89. The forward-facing channel 89 is adapted to receive the respective other rear post end portion 96. The upwardly extending rear post engaging member 88 is further shaped and dimensioned to define a lower post collapsing aperture 91 substantially adjacent to the forward-facing-channel 89. The upwardly extending rear post engaging member 88 is further provided with a lower rear post fastening means 90 for securely and pivotably fastening the rear post member 92 thereto. As best seen in FIGS. 28 through 31, the lower rear post fastening means 90 may take the form of a nut and bolt assembly that extends through the rear interposed fastening aperture 114 and is secured to the upwardly extending rear post engaging member 88.

The rear post member 92 preferably includes upper and lower folding bar members 98, 110 engaging one another in hingedly secured relation. The upper folding bar member 98 has a first hinged end portion 100*b* and an opposed upward end portion 100*a* that is coterminous with the first rear post end portion 94. The lower folding bar member 110 has a second hinged end portion 112*a* and an opposed downward end portion 112*b* that is coterminous with the respective other rear post end portion 96. The first and second hinged end portions 100*b*, 112*a* engaging one another in the aforesaid hingedly secured relation.

Figure 34:
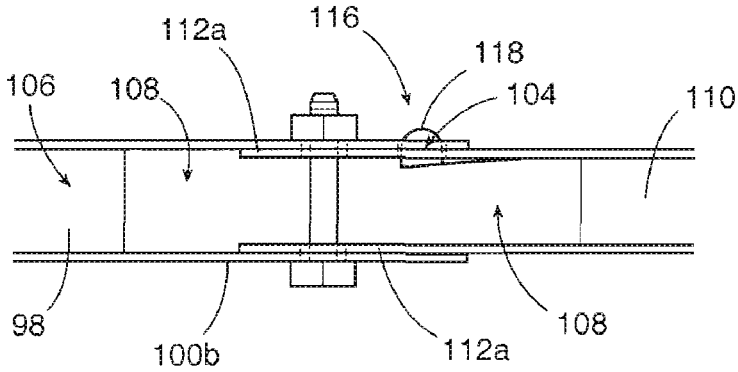
FIG. 34 is a view of the rear post member along sight line 34-34 of FIG. 31, shown in a locked configuration.
Figure 35:
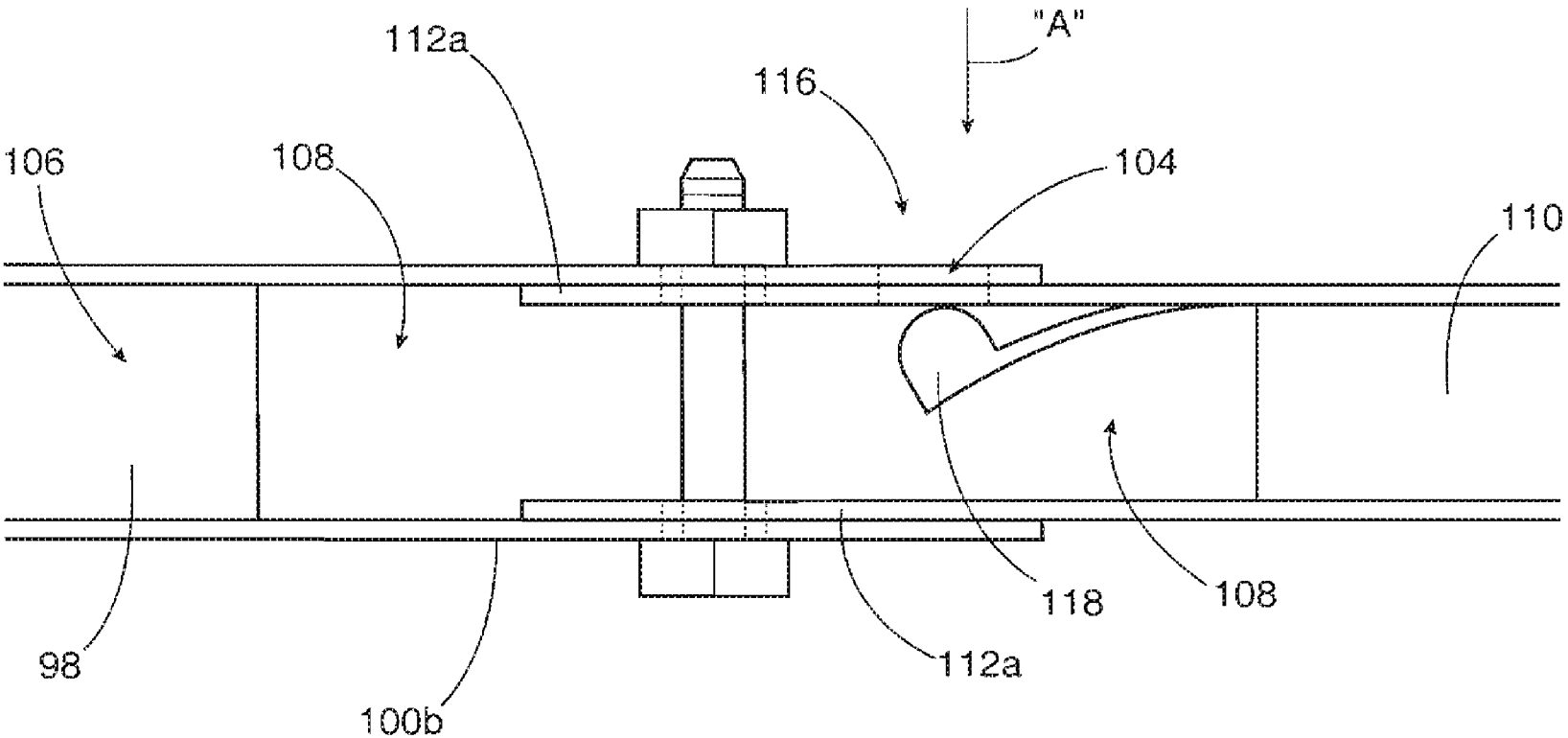
FIG. 35 is a view of the rear post member similar to FIG. 34, shown in an unlocked configuration.

Preferably, the upper folding bar member 98 is shaped and dimensioned so as to define a longitudinal channel 106 extending therealong from the first hinged end portion 100*b* towards the upward end portion 100*a*. As best shown in FIGS. 34 and 35, the longitudinal channel 106 is adapted to receive the second hinged end portion 112*a* of the lower folding bar member 110. The upper folding bar member 98 is preferably further shaped so as to define a locking aperture 104 extending through the upper folding bar member 98 substantially adjacent to the longitudinal channel 106 in a first substantially transverse direction (as indicated by arrow "A" in FIGS. 11, 12 and 35). The upper folding bar is preferably still further shaped and dimensioned so as to define an unlocking aperture 108 substantially adjacent to the longitudinal channel 106 and extending therethrough in a second substantially transverse direction (as indicated by arrow "B" in FIGS. 11, 13 and 32).

The rear post member 92 further includes a locking means 116 for selective movement of the upper and lower folding bar members 98, 110 between a locked configuration (best seen in FIGS. 1, 13 and 34) and an unlocked configuration (best seen in FIGS. 3 and 35). The locking means 116 comprises a locking pin member or locking pushbutton member 118.

In the locked configuration, and as best seen in FIG. 34, the locking pushbutton member 118 securely engages the locking aperture 104 of the upper folding bar member 98 in depressably removable through-passing relation, and further engages the lower folding bar member 110. The locking pushbutton member 118 is biased towards the locked configuration shown in FIG. 34, such as to securely engage the locking aperture 104, as aforesaid, when the upper and lower folding bar members 98, 110 are aligned in the substantially collinear relation shown in FIGS. 1, 13, and 34. Further, in the locked configuration, the upper and lower folding bar members 98, 110 are securely maintained in the substantially collinear relation, with the upper and lower supporting members in the erect configuration (shown in FIG. 1).

In order to reach the unlocked configuration, and as best seen in FIG. 35, the locking pushbutton member 118 may be depressed to remove it from securely engagement with the locking aperture 104 of the upper folding bar member 98. In the unlocked configuration (and as best seen in FIG. 3), the unlocking aperture 108 of the upper folding bar member 98 is adapted to receive the second hinged end portion 112*a* of the lower folding bar member 110. In the unlocked configuration, the upper and lower folding bar members 98, 110 are permitted to move from the substantially collinear relation (shown in FIGS. 1 and 13), and the upper and lower supporting members are permitted to move from the erect configuration (shown in FIG. 1), through intermediate first and second unlocked configurations (shown in FIGS. 2-3 and 5-7), towards the collapsed configuration (shown in FIGS. 8-9 and 14).

Figure 13:
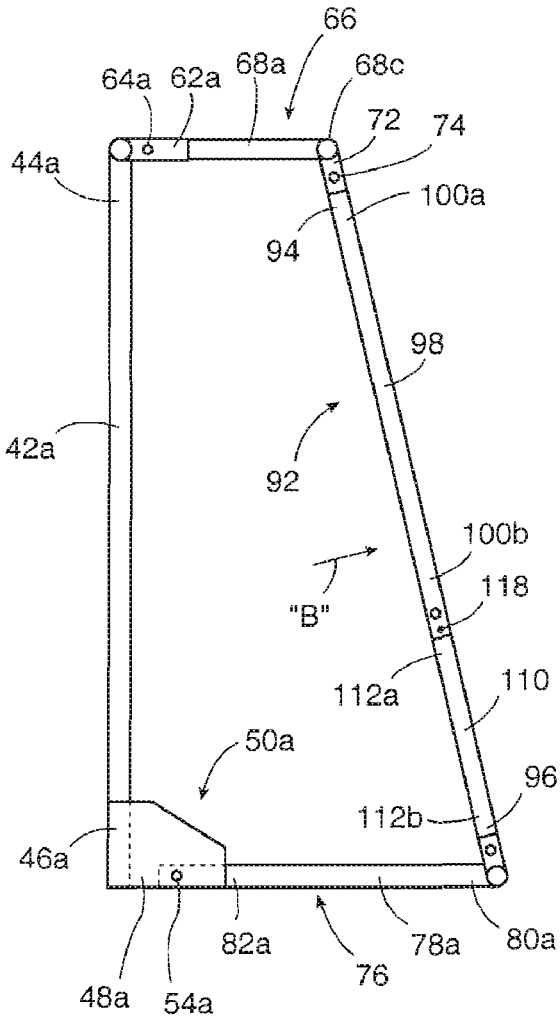
FIG. 13 is a right side elevational view of the collapsible sports goal along sight line 13-13 of FIG. 12.

Turning now to a description of the erect configuration, which is best seen in FIGS. 1 and 13, the rear post member 92 extends substantially vertically, and the left and right support bars 78*a*, 78*b* extend rearwardly and substantially normal to each of the upright goal posts 42*a*, 42*b*. Each upper bar end portion 68*a*, 68*b* extends in a substantially horizontal direction. Each of the upper bar central portion 68*c* and the rear interposed member 78*c* is substantially horizontal. It will be further appreciated from FIGS. 1 and 11-13 that, in the erect configuration, the upper and lower folding bar 98, 110 members extend in substantially collinear relation.

Figure 14:
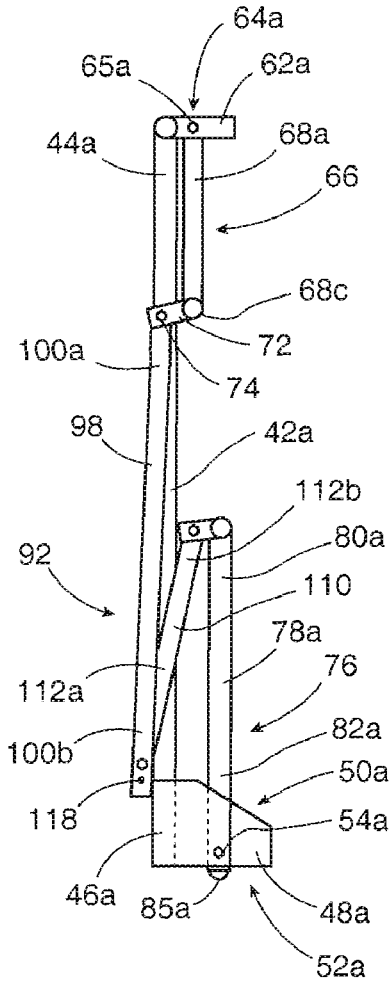
FIG. 14 is a right side elevational view of the collapsible sports goal similar to FIG. 13, shown in the collapsed configuration.
Figure 15:
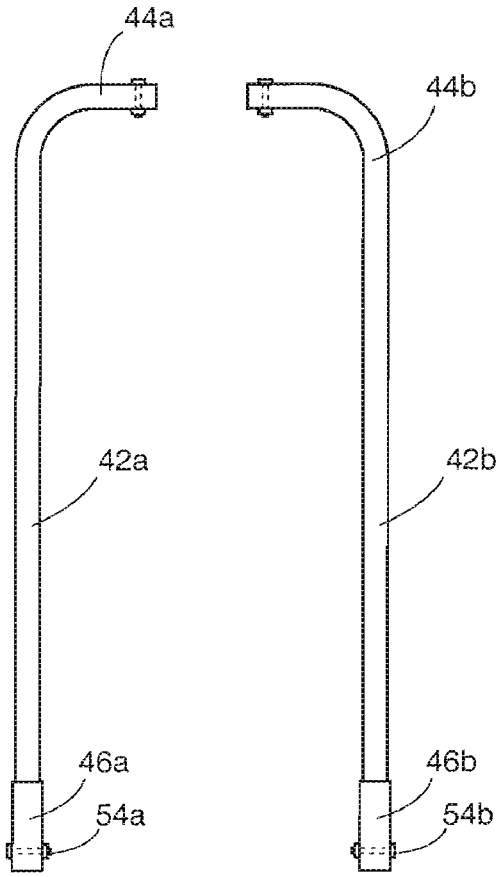
FIG. 15 is an exploded front elevational view of upright goal posts shown in FIG. 12.
Figure 16:
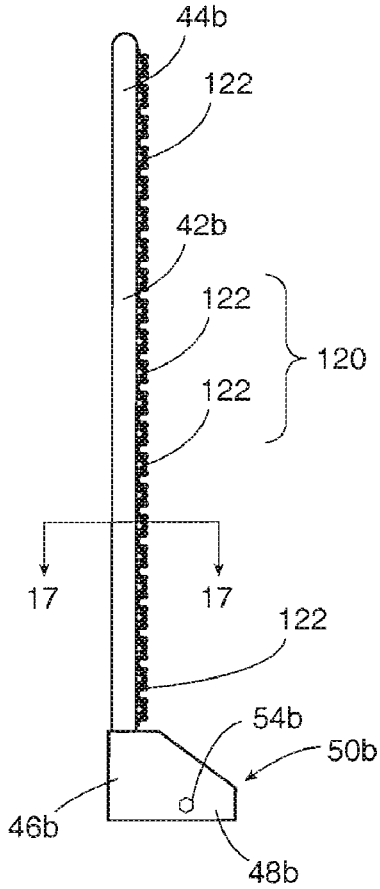
FIG. 16 is a right side elevational view of an upright goal post of FIG. 15.

On the other hand, in the collapsed configuration, and as best seen in FIGS. 8, 9 and 14, the left and right support bars 78*a*, 78*b* extend substantially parallel to the upright goal posts 42*a*, 42*b* in a substantially vertical direction. Each upper bar end portion 68*a*, 68*b* will likewise be seen to extend in a substantially vertical direction. It should be appreciated from FIGS. 8 and 9 that each of the upper bar central portion 68*c* and the rear interposed member 78*c* maintains a substantially horizontal orientation in the collapsed configuration. It will be further appreciated from FIGS. 8-9 and 14 that, in the collapsed configuration, the upper and lower folding bar members 98, 110 are removed from the substantially collinear relation. As will be best appreciated from FIG. 14, wherein representative post upper end and lower base portions 44*a*, 46*a* are depicted, each upper collapsing aperture 65*a*, 65*b* is adapted to receive a respective one of the upper bar end portions 68*a*, 68*b*, and each lower collapsing aperture 52*a*, 52*b* is adapted to receive a respective one of the forward end portions 82*a*, 82*b* of the left and right support bars 78*a*, 78*b*, in the collapsed configuration. As shown in FIGS. 14 and 24-26, each of the forward end portions 82*a*, 82*b* is preferably further provided with a respective wheel member 85*a*, 85*b* which, as best seen in FIG. 14, protrudes through a respective one of the lower collapsing apertures 52*a*, 52*b* in the collapsed configuration. As further expanded upon below, the wheel members 85*a*, 85*b* allow the collapsible sports goal 40 to be easily rolled out of the way when it is in the collapsed configuration.

According to the preferred embodiment of the invention (and as shown in FIGS. 1 through 10), the sports goal 40 preferably also includes a web 124 of netting material and a net attaching means 120 for readily attaching the web 124 to the upright goal posts 42*a*, 42*b*, the front crossbar 58, the support bars 78*a*, 78*b*, and the rear interposed member 78*c*. The net attaching means 120 includes a plurality of spiral bent eyelets 122 securely affixed, in substantially continuous relation to one another, to substantially rearward facing portions of the upright goal posts 42*a*, 42*b* and the front crossbar 58, and to substantially upward facing portions of the support bars 78*a*, 78*b* and the rear interposed member 78*c*. The substantially continuous organization of the spiral bent eyelets 122 provides improved strength of attachment between the web 124 and each of the corresponding portions of the sports goal 40. In addition, it will be appreciated from FIGS. 5 through 9, among others, that the net attaching means 120 does not require any additional string engaging the periphery of the web 124, nor removal or re-attachment of the web 124 of netting during movement between the erect and collapsed configurations according to the present invention.

In use, whether in a hockey game or otherwise, the collapsible sports goal 40 might be employed just as a regular sports goal. When game play has ended or is otherwise suspended, however, a single user 36 of young age may quite easily collapse the sports goal 40 by first depressing the locking pushbutton member 118. In so doing, and according to the preferred embodiment of the invention shown in FIGS. 1 through 10, the user 36 thereby allows the sports goal 40 to move, under its own weight, from the erect configuration (best seen in FIG. 1) to the first unlocked configuration (best seen in FIGS. 2 and 5). From that point, it is a simple matter for the user 36 to grasp the lower supporting member 76 and move sports goal from the first unlocked configuration (best seen in FIGS. 2 and 5), through the second unlocked configuration (shown in FIG. 6), to the collapsed configuration (best seen in FIGS. 7 and 9). As may be best appreciated from FIG. 14, when the sports goal 40 is in the collapsed configuration, the wheel members 85*a*, 85*b* allow the user 36 to more easily transport and place it in storage. As also seen in FIG. 9, the sports goal 40 may then be easily stored by the user 36—whether hung substantially flat against a garage wall 37 (as seen in FIG. 9), moved indoors and stored in a basement, or otherwise. As such, the sports goal 40 according to the present invention will be seen to comprise a readily collapsible hockey goal 40 that is suitable to withstand the rigors of a spirited game of hockey and is yet easily portable, without requiring any preliminary disassembly into a plurality of subassemblies before collapsing same into a storage configuration that takes up a small storage envelope when not in use. It is noted that the rear folding means makes the collapsible sports goal 40 substantially more rugged that any prior art sports goals comprising side folding and bracing means, whether in combination with anchor means or otherwise. The design concept behind the collapsible sports goal 40 of the present invention allows it to be capable of use in other sports contexts, and also allows a child of young age 36 to assemble or dissemble same without requiring any hand tools, parental supervision or assistance.

Of course, other modifications and alterations may be used in the design and manufacture of the collapsible sports goal 40 according to the present invention without departing from the spirit and scope of the invention, which is limited only by the accompanying claims. For example, and without limitation, secondary locking means including, for example, a secondary locking button (not shown) or a locking strap (not shown), might be provided to maintain the sports goal 40 in the collapsed configuration. Given the various alternate embodiments of the collapsible sports goal 40 according to the present invention, of which the aforesaid secondary locking means is merely an example, it is perhaps worthwhile to once again note that the invention is limited only by any accompanying claims.

I claim:

1. A collapsible sports goal comprising:

a) left and right upright goal posts, each respectively having a post upper end portion and a lower base portion;

b) supporting members comprising:

i) an upper supporting member that includes a substantially horizontal front crossbar having left and right crossbar end portions, with each of said crossbar end portions securely engaging a respective one said post upper end portion;

ii) a lower supporting member that includes left and right support bars and a rear interposed member, each of said left and right support bars respectively having a forward end portion and a rearward end portion, said interposed member substantially juxtaposed in secure relation between said left and right support bars substantially adjacent to each said rearward end portion, with each said forward end portion securely and pivotably engaging a respective one of said upright goal posts substantially adjacent to each said lower base portion; and c) a rear folding means, engaging said lower supporting member in secure relation and engaging said upper supporting member in secure pivotable relation, for selective pivoting of said lower supporting member between an erect configuration and a collapsed configuration; in said erect configuration, each of said left and right support bars extends rearwardly of and substantially normal to each of said upright goal posts; and in said collapsed configuration, each of said left and right support bars extends substantially parallel to each of said upright goal posts in a substantially vertical direction;

said rear folding means comprises an elongate rear post member having opposed rear post end portions, with a first one of said rear post end portions engaging said upper supporting member in said secure pivotable relation, and with a respective other one of said rear post end portions pivotably engaging said lower supporting member in said secure relation; and wherein in said erect configuration, said rear post member extends substantially vertically;

wherein said rear interposed member is a substantially horizontal elongate member having left and right interposed end portions and an interposed central portion, with each of said interposed end portions securely engaging a respective one said rearward end portion, and with said respective other one of said rear post end portions pivotably engaging said interposed central portion in said secure relation;

said upper supporting member further comprises a rear upper bar member having left and right upper bar end portions and a substantially horizontal upper bar central portion, with each of said upper bar end portions securely and pivotably extending from substantially adjacent to a respective one of said post upper end portions, and with said first one of said rear post end portions engaging said rear upper bar member in said secure pivotable relation;

said upper bar central portion is substantially parallel to said front crossbar, and wherein each of said upper bar end portions extends in a substantially normal direction relative to said front crossbar;

wherein in said erect configuration, each of said upper bar end portions extends in a substantially horizontal direction; and in said collapsed configuration, each of said upper bar end portions extends in a substantially vertical direction;

said rear post member comprises an elongate upper folding bar member and an elongate lower folding bar member, said upper folding bar member having a first hinged end portion and an opposed upward end portion that is substantially coterminous with said first one of said rear post end portions, said lower folding bar member having a second hinged end portion and an opposed downward end portion that is substantially coterminous with said respective other one of said rear post end portions; with said first hinged end portion engaging said second hinged end portion in hingedly secured relation;

wherein in said erect configuration, said upper folding bar member extends in substantially collinear relation with said lower folding bar member; and in said collapsed configuration, said upper folding bar member is removed from said substantially collinear relation with said lower folding bar member;

said rear post member further comprises a locking means for selective movement of said upper folding bar member and said lower folding bar member between a locked configuration and an unlocked configuration; in said locked configuration, said upper folding bar member is securely maintained in said substantially collinear relation with said lower folding bar member, with said upper supporting member and said lower supporting member in said erect configuration; in said unlocked configuration, said upper folding bar member and said lower folding bar member are each permitted to move from said substantially collinear relation, and said upper supporting member and said lower supporting member are permitted to move between said erect configuration and said collapsed configuration;

a first folding bar member of said upper folding bar member and said lower folding bar member is shaped to define a locking aperture extending therethrough in a first substantially transverse direction; wherein said locking means comprises a locking pin member engaging a respective other folding bar member of said upper folding bar member and said lower folding bar member; wherein in said locked configuration, said locking pin member securely engages said locking aperture in removable through-passing relation; and wherein in said unlocked configuration, said locking pin member is removed from said secure engagement with said locking aperture;

wherein said locking pin member comprises a selectively depressable locking pushbutton member that is biased towards said locked configuration such that, when said upper folding bar member is in said substantially collinear relation with said lower folding bar member as aforesaid, said locking pushbutton member extends into secure depressably removable through-passing engagement with said locking aperture.

2. A collapsible sports goal according to claim 1, wherein each of said upper bar end portions securely and pivotably extending from substantially adjacent to a respective one of said crossbar end portions.

3. A collapsible sports goal according to claim 1, wherein said first one of said rear post end portions engages said upper bar central portion of said rear upper bar member in said secure pivotable relation.

4. A collapsible sports goal according to claim 1, wherein said first folding bar member is said upper folding bar member, and wherein said respective other folding bar member is said lower folding bar member.

5. A collapsible sports goal according to claim 1, wherein each lower base portion of each of said upright goal posts comprises a rearwardly extending portion that is shaped and dimensioned so as to each respectively define a rearward extending upward-facing channel, with each said upward-facing channel adapted to receive a respective one said forward end portion of said support bars; wherein each said rearwardly extending portion is further shaped and dimensioned so as to define a respective lower collapsing aperture substantially adjacent to said respective upward-facing channel and extending therethrough in a substantially venical direction, with each said lower collapsing aperture adapted to receive a respective one said forward end portion of said support bars in said collapsed configuration.

6. A collapsible sports goal comprising:

a) left and right upright goal posts, each respectively having a post upper end portion and a lower base portion;

b) supporting members comprising:

i) an upper supporting member that includes a substantially horizontal front crossbar having left and right crossbar end portions, with each of said crossbar end portions securely engaging a respective one said post upper end portion;

ii) a lower supporting member that includes left and right support bars and a rear interposed member, each of said left and right support bars respectively having a forward end portion and a rearward end portion, said interposed member substantially juxtaposed in secure relation between said left and right support bars substantially adjacent to each said rearward end portion, with each said forward end portion securely and pivotably engaging a respective one of said upright goal posts substantially adjacent to each said lower base portion; and c) a rear folding means, engaging said lower supporting member in secure relation and engaging said upper supporting member in secure pivotable relation, for selective pivoting of said lower supporting member between an erect configuration and a collapsed configuration; in said erect configuration, each of said left and right support bars extends rearwardly of and substantially normal to each of said upright goal posts; and in said collapsed configuration, each of said left and right support bars extends substantially parallel to each of said upright goal posts in a substantially vertical direction;

said rear folding means comprises an elongate rear post member having opposed rear post end portions, with a first one of said rear post end portions engaging said upper supporting member in said secure pivotable relation, and with a respective other one of said rear post end portions pivotably engaging said lower supporting member in said secure relation; and wherein in said erect configuration, said rear post member extends substantially vertically;

wherein said rear interposed member is a substantially horizontal elongate member having left and right interposed end portions and an interposed central portion, with each of said interposed end portions securely engaging a respective one said rearward end portion, and with said respective other one of said rear post end portions pivotably engaging said interposed central portion in said secure relation;

said upper supporting member further comprises a rear upper bar member having left and right upper bar end portions and a substantially horizontal upper bar central portion, with each of said upper bar end portions securely and pivotably extending from substantially adjacent to a respective one of said post upper end portions, and with said first one of said rear post end portions engaging said rear upper bar member in said secure pivotable relation;

said upper bar central portion is substantially parallel to said front crossbar, and wherein each of said upper bar end portions extends in a substantially normal direction relative to said front crossbar;

wherein in said erect configuration, each of said upper bar end portions extends in a substantially horizontal direction; and in said collapsed configuration, each of said upper bar end portions extends in a substantially vertical direction;

said rear post member comprises an elongate upper folding bar member and an elongate lower folding bar member, said upper folding bar member having a first hinged end portion and an opposed upward end portion that is substantially coterminous with said first one of said rear post end portions, said lower folding bar member having a second hinged end portion and an opposed downward end portion that is substantially coterminous with said respective other one of said rear post end portions; with said first hinged end portion engaging said second hinged end portion in hingedly secured relation;

wherein in said erect configuration, said upper folding bar member extends in substantially coilinear relation with said lower folding bar member; and in said collapsed configuration, said upper folding bar member is removed from said substantially collinear relation with said lower folding bar member;

said rear post member further comprises a locking means for selective movement of said upper folding bar member and said lower folding bar member between a locked configuration and an unlocked configuration; in said locked configuration, said upper folding bar member is securely maintained in said substantially collinear relation with said lower folding bar member, with said upper supporting member and said lower supporting member in said erect configuration; in said unlocked configuration, said upper folding bar member and said lower folding bar member are each permitted to move from said substantially collinear relation, and said upper supporting member and said lower supporting member are permitted to move between said erect configuration and said collapsed configuration;

a first folding bar member of said upper folding bar member and said lower folding bar member is shaped to define a locking aperture extending therethrough in a first substantially transverse direction; wherein said locking means comprises a locking pin member engaging a respective other folding bar member of said upper folding bar member and said lower folding bar member; wherein in said locked configuration, said locking pin member securely engages said locking aperture in removable through-passing relation; and wherein in said unlocked configuration, said locking pin member is removed from said secure engagement with said locking aperture;

wherein said upper folding bar member is shaped and dimensioned to define a substantially longitudinal channel extending therealong from substantially adjacent to said first hinged end portion towards said upward end portion, with said longitudinal channel being adapted to receive said second hinged end portion; wherein said locking aperture extends as aforesaid through said first folding bar member substantially adjacent to said longitudinal channel; wherein said upper folding bar is further shaped and dimensioned to define an unlocking aperture substantially adjacent to said longitudinal channel and extending therethrough in a second substantially transverse direction, with said unlocking aperture adapted to receive said second hinged end portion in said unlocked configuration.

7. A collapsible sports goal comprising:

a) left and right upright goal posts, each respectively having a post upper end portion and a lower base portion;

b) supporting members comprising:

i) an upper supporting member that includes a substantially horizontal front crossbar having left and right crossbar end portions, with each of said crossbar end portions securely engaging a respective one said post upper end portion;

ii) a lower supporting member that includes left and right support bars and a rear interposed member, each of said left and right support bars respectively having a forward end portion and a rearward end portion, said interposed member substantially juxtaposed in secure relation between said left and right support bars substantially adjacent to each said rearward end portion, with each said forward end portion securely and pivotably engaging a respective one of said upright goal posts substantially adjacent to each said lower base portion; and c) a rear folding means, engaging said lower supporting member in secure relation and engaging said upper supporting member in secure pivotable relation, for selective pivoting of said lower supporting member between an erect configuration and a collapsed configuration; in said erect configuration, each of said left and right support bars extends rearwardly of and substantially normal to each of said upright goal posts; and in said collapsed configuration, each of said left and right support bars extends substantially parallel to each of said upright goal posts in a substantially vertical direction;

wherein said rear folding means comprises an elongate rear post member having opposed rear post end portions, with a first one of said rear post end portions engaging said upper supporting member in said secure pivotable relation, and with a respective other one of said rear post end portions pivotably engaging said lower supporting member in said secure relation; and wherein in said erect configuration, said rear post member extends substantially vertically;

wherein said rear interposed member is a substantially horizontal elongate member having left and right interposed end portions and an interposed central portion, with each of said interposed end portions securely engaging a respective one said rearward end portion, and with said respective other one of said rear post end portions pivotably engaging said interposed central portion in said secure relation;

wherein said upper supporting member further comprises a rear upper bar member having left and right upper bar end portions and a substantially horizontal upper bar central portion, with each of said upper bar end portions securely and pivotably extending from substantially adjacent to a respective one of said post upper end portions, and with said first one of said rear post end portions engaging said rear upper bar member in said secure pivotable relation;

wherein each post upper end portion of each of said upright goal posts comprises a rearwardly extending upper bar engaging portion that is shaped and dimensioned so as to each respectively define a rearward extending downward-facing channel, with each said downward-facing channel adapted to receive a respective one of said upper bar end portions; wherein each said upper bar engaging portion is further shaped and dimensioned so as to define a respective upper collapsing aperture substantially adjacent to said respective downward-facing channel and extending therethrough in a substantially vertical direction, with each said upper collapsing aperture adapted to receive a respective one of said upper bar end portions in said collapsed configuration.

8. A collapsible sports goal according to claim 7 further comprising a web of netting material and a net attaching means for readily attaching said web to said upright goal posts, said front crossbar, said support bars, and said rear interposed member.

9. A collapsible sports goal according to claim 8, wherein said net attaching means comprises a plurality of spiral bent eyelets securely affixed to said upright goal posts, said front crossbar, said support bars, and said rear interposed member in substantially continuous relation to one another.

10. A collapsible sports goal according to claim 9, wherein said plurality of bent steel eyelets is affixed to a substantially rearward facing portion of each of said upright goal posts and said front crossbar, and to a substantially upward facing portion of each of said support bars and said rear interposed member.

* * * * *